US005940010A

United States Patent [19]

Sasaki et al.

[11] Patent Number: 5,940,010

[45] Date of Patent: Aug. 17, 1999

[54] INTERSECTION WARNING SYSTEM

[75] Inventors: Kenji Sasaki, Gotenba; Yuji Kobayashi, Fuchu; Noriaki Hattori, Anjo; Kazuhiko Yamaguchi, Gifu, all of Japan

[73] Assignees: Toyota Jidosha Kabushiki Kaisha; Hino Jidosha Kogyo Kabushiki Kaisha; Aisin Seiki Kabushiki Kaisha; Denso Corporation, all of, Japan

[21] Appl. No.: 09/126,131

[22] Filed: Jul. 30, 1998

[30] Foreign Application Priority Data

Jul. 31, 1997 [JP] Japan ..... 9-206971

[51] Int. Cl.[6] ..... G08G 1/00

[52] U.S. Cl. ..... 340/901; 340/905; 340/907; 340/929; 340/436

[58] Field of Search ..... 340/435, 916, 340/917, 918, 933, 936, 937, 938, 906, 913, 914, 905, 907, 901, 904, 929

[56] References Cited

U.S. PATENT DOCUMENTS

| | | | |
|---|---|---|---|
| 4,908,616 | 3/1990 | Walker | 340/929 |
| 5,313,200 | 5/1994 | Sone | 340/905 |
| 5,315,295 | 5/1994 | Fujii | 340/936 |
| 5,448,219 | 9/1995 | Yoshikawa et al. | 340/436 |
| 5,617,086 | 4/1997 | Klashingky et al. | 340/907 |
| 5,635,920 | 6/1997 | Pogue et al. | 340/901 |

FOREIGN PATENT DOCUMENTS

| | | |
|---|---|---|
| 3-271999 | 12/1991 | Japan . |
| 4-236698 | 8/1992 | Japan . |
| 6-231396 | 8/1994 | Japan . |

*Primary Examiner*—Jeffery A. Hofsass
*Assistant Examiner*—Van T. Trieu
*Attorney, Agent, or Firm*—Finnegan, Henderson, Farabow, Garrett & Dunner, L.L.P.

[57] ABSTRACT

An intersection warning system provided in a vehicle includes a distance detecting unit detecting a distance between a position at which the vehicle runs toward an intersection and a boundary position (a stop line) set for vehicles to stop before the intersection, a running state detecting unit detecting a running state of the vehicle, a determination unit determining whether the detected running state of the vehicle is appropriate by estimating a running state of the vehicle at the boundary position based on the distance detected by the distance detecting unit and the detected running state of the vehicle, and a warning unit issuing a warning to a driver of the vehicle based on a result obtained by the determination unit.

6 Claims, 7 Drawing Sheets

INTERSECTION WARNING SYSTEM

BACKGROUND OF THE INVENTION

1. Field of the Invention

The present invention relates to an intersection warning system, and more particularly to an intersection warning system which issues a warning to a driver of a vehicle approaching an intersection based on a running state of the vehicle and a boundary position (a stop line) set for vehicles to stop before the intersection.

2. Description of the Related Art

Conventionally, a vehicle warning apparatus provided in a vehicle has been proposed (Japanese Laid-Open Patent Application No.4-236698). When it is determined that the vehicle is going to enter a blind intersection, such as in a case where the vehicle running on a side road is going to enter a main road, a switching-on control of flashing lamps of the vehicle is carried out. According to the vehicle warning apparatus, the switched-on flashing lamps can warn other vehicles, running on the main road and approaching the blind intersection, that the vehicle from the side road is going to enter the main road. As a result, a sudden collision between vehicles at such a blind intersection can be avoided.

However, a driver of the vehicle approaching the intersection on the side road may fail to notice a stop line before the intersection or a state of a traffic signal at the intersection. In this case, the vehicle running on the side road does not stop at a position, before the intersection, at which vehicles should stop. Thus, even if the flashing lamps of the vehicle are switched on in this case, the collision between the vehicle and another vehicle passing the intersection on the main road may not be avoided.

SUMMARY OF THE INVENTION

Accordingly, a general object of the present invention is to provide a novel and useful intersection warning system in which the disadvantages of the aforementioned prior art are eliminated.

A specific object of the present invention is to provide an intersection warning system by which a driver of a vehicle approaching an intersection can have his/her attention called to stopping the vehicle at a boundary position (a stop line) set for vehicles to stop before the intersection.

The objects of the present invention are achieved by an intersection warning system provided in a vehicle comprising: a distance detecting unit detecting a distance between a position at which the vehicle runs toward an intersection and a boundary position set for vehicles to stop before the intersection; a running state detecting unit detecting a running state of the vehicle; a determination unit determining whether the detected running state of the vehicle is appropriate by estimating a running state of the vehicle at the boundary position based on the distance detected by the distance detecting unit and the detected running state of the vehicle; and a warning unit issuing a warning to a driver of the vehicle based on a result obtained by the determination unit.

According to such an intersection warning system, the running state, at the boundary position, of the vehicle approaching the intersection is estimated, and it is determined based on the estimate result whether the present running state is appropriate for the vehicle to stop before the boundary position. A warning is then issued to the driver based on the determination result.

The boundary position is decided for every intersection. In a case where there is a stop line before the intersection, for example, the position of the stop line is decided as the boundary position. The running state of the vehicle which is to be detected includes the position and speed of the vehicle.

To apply the intersection warning system according to the present invention to an intersection at which a traffic signal is provided, the intersection warning system according to the present invention may further comprise a signal state receiving unit receiving information about a signal state of a traffic signal provided at the intersection and a switching cycle of the traffic signal from a roadside system, and an estimate unit estimating the signal state of the traffic signal when the vehicle enters the intersection based on the detected distance to the boundary position, the detected running state and the information received by the signal state receiving unit, wherein the determination unit determines whether the detected running state is appropriate additionally based on the estimate result obtained by the estimate unit.

According to such an intersection warning system, the state of the traffic signal when the vehicle enters the intersection is estimated. It is determined, additionally based on the estimate result (estimated signal states: red, yellow or green), whether the present running state is appropriate for the vehicle to stop before the boundary position. For example, when the estimated signal state is a state (e.g., a "green" state) indicating that the vehicle is allowed to pass through the intersection, the vehicle maintaining the present running state can pass through the intersection. In this case, it is determined that the present running state is appropriate. On the other hand, when the estimated signal state is a state (e.g., a "red" state) indicating that the vehicle is not allowed to pass through the intersection, it is determined whether the detected running state is appropriate for the vehicle to stop before the boundary position. Based on the determination result, the warning is issued to the driver.

To avoid contact between the vehicle and another vehicle at the intersection even if the driver does not correct the driving operation when the warning is issued, the intersection warning system according to the present invention may further comprise a braking control unit carrying out a braking control of the vehicle based on the result obtained by the determination unit.

According to such an intersection warning system, if the detected running state is not appropriate, the braking control is performed to cause the vehicle to stop before the boundary position.

BRIEF DESCRIPTION OF THE DRAWINGS

Other objects, features and advantages of the present invention will be apparent from the following description when read in conjunction with the accompanying drawings, in which.

DESCRIPTION OF THE PREFERRED EMBODIMENTS

A description will be given, with reference to the drawings, of an embodiment of the present invention.

Figure 1:
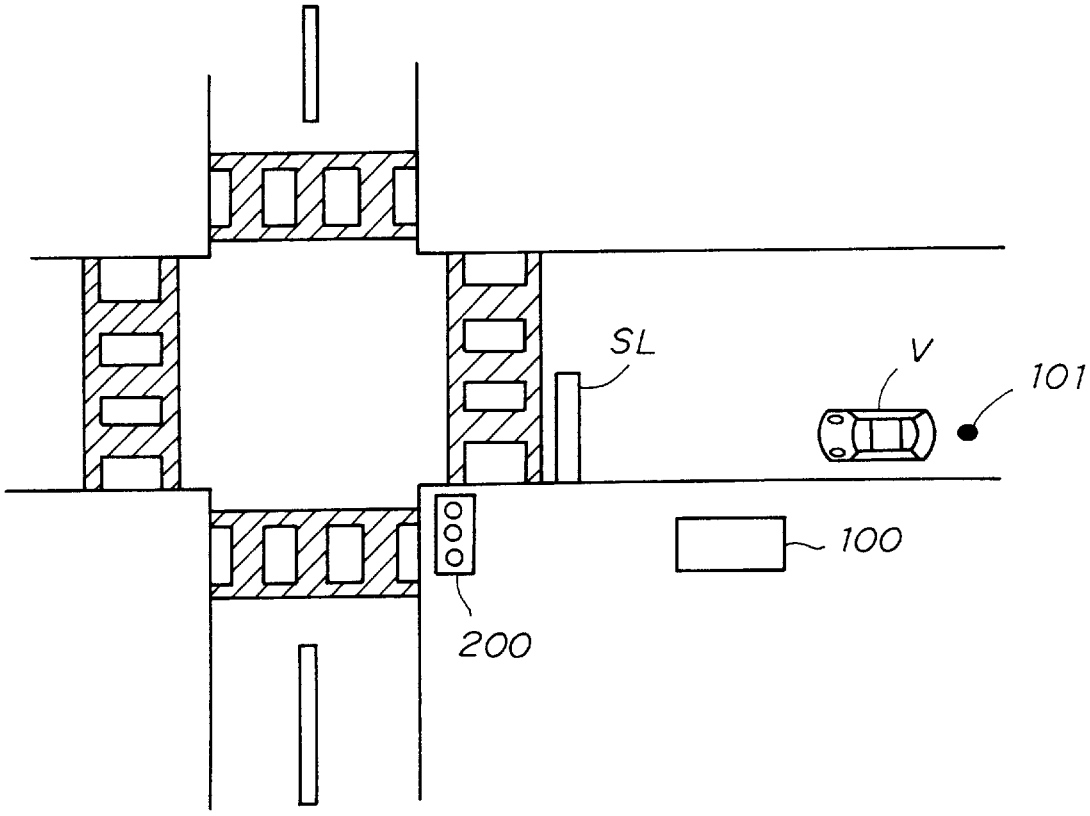
FIG. 1 is a diagram illustrating an example of a constitution of an intersection.

An intersection for which an intersection warning system according to the embodiment of the present invention is useful is formed as shown in FIG. 1. Referring to FIG. 1, a lane marker 101 is installed at a predetermined position before an intersection at which a traffic signal 200 is installed. The position of the lane marker 101 is decided based on a braking characteristic of a vehicle. For example, at a position 50 meters before a stop line SL, the lane marker 101 is installed. A distance of 50 meters corresponds to a distance required for a vehicle running at a speed of 60 km/h to stop before the stop line SL at a deceleration of 0.3 G.

The lane marker 101 has a function for emitting information about the presence of the traffic signal, the distance between the lane marker 101 and the stop line SL, a position of the lane marker 101 and a direction in which a vehicle approaches the intersection. The lane marker 101 is formed, for example, of a set of a plurality of magnets (a magnetic marker). Directions of magnetic poles of the plurality of magnets represent the above information.

A switching state of the traffic light 200 is watched by a road watching apparatus (not shown). On a roadside of an area between the lane marker 101 and the stop line, a roadside communication unit 100 is installed. The roadside communication unit 100 transmits watching information supplied from the road watching apparatus toward a predetermined communication area over the road.

Figure 2:
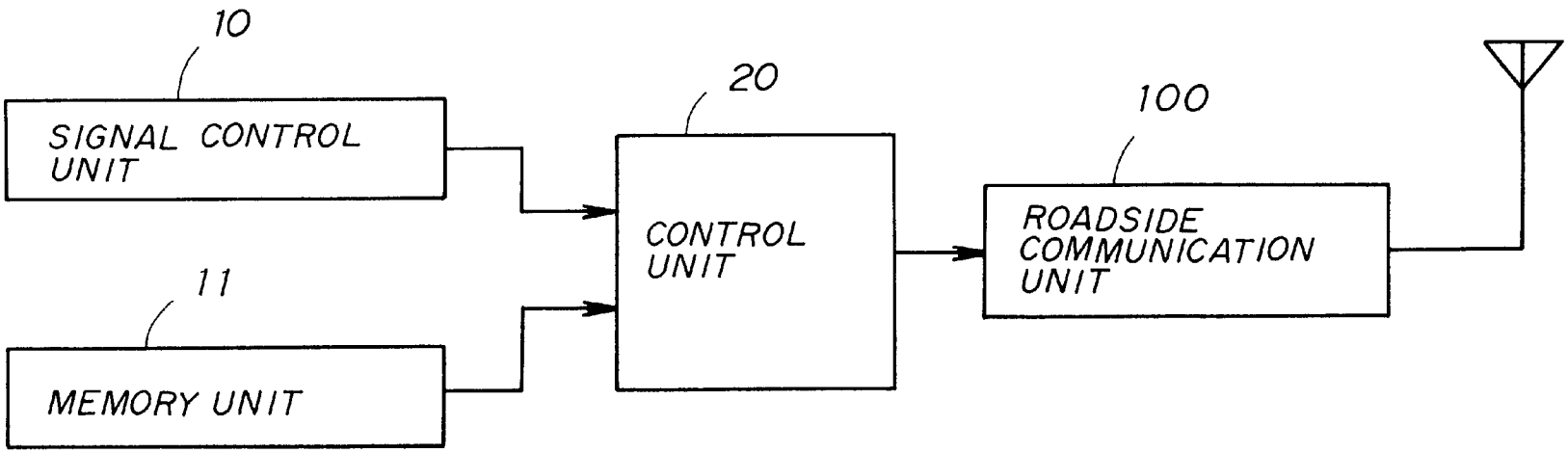
FIG. 2 is a block diagram illustrating a roadside system installed near the intersection.

A roadside system having a road watching apparatus and the roadside communication unit 100 is formed as shown in FIG. 2.

Referring to FIG. 2, the roadside system has a signal control unit 10, a memory unit 11, a control unit 20 and the roadside communication unit 100. The signal control unit 10, the memory unit 11 and the control unit 20 are included in the road watching apparatus. The watching information is supplied from the control unit 20 to the roadside communication unit 100.

The signal control unit 10 outputs a state (red, yellow or green) of the traffic signal 200 installed at the intersection. The memory unit 11 stores map information and information about a switching cycle of the traffic signal 200 (time periods of red, yellow and green states). The control unit 20 calculates an elapsed time of a present state of the traffic signal 200 based on information about the state of the traffic signal 200 from the signal control unit 10 and generates timing information (corresponding to the elapsed time of the present state of the traffic signal 200). In addition, the control unit 20 calculates figure information of the intersection based on the map information read out of the memory unit 11. The above timing information, and the information about the switching cycle of the traffic signal 200 and the figure information of the intersection both of which are read out of the memory unit, are supplied as the watching information to the roadside communication unit 100.

Figure 3:
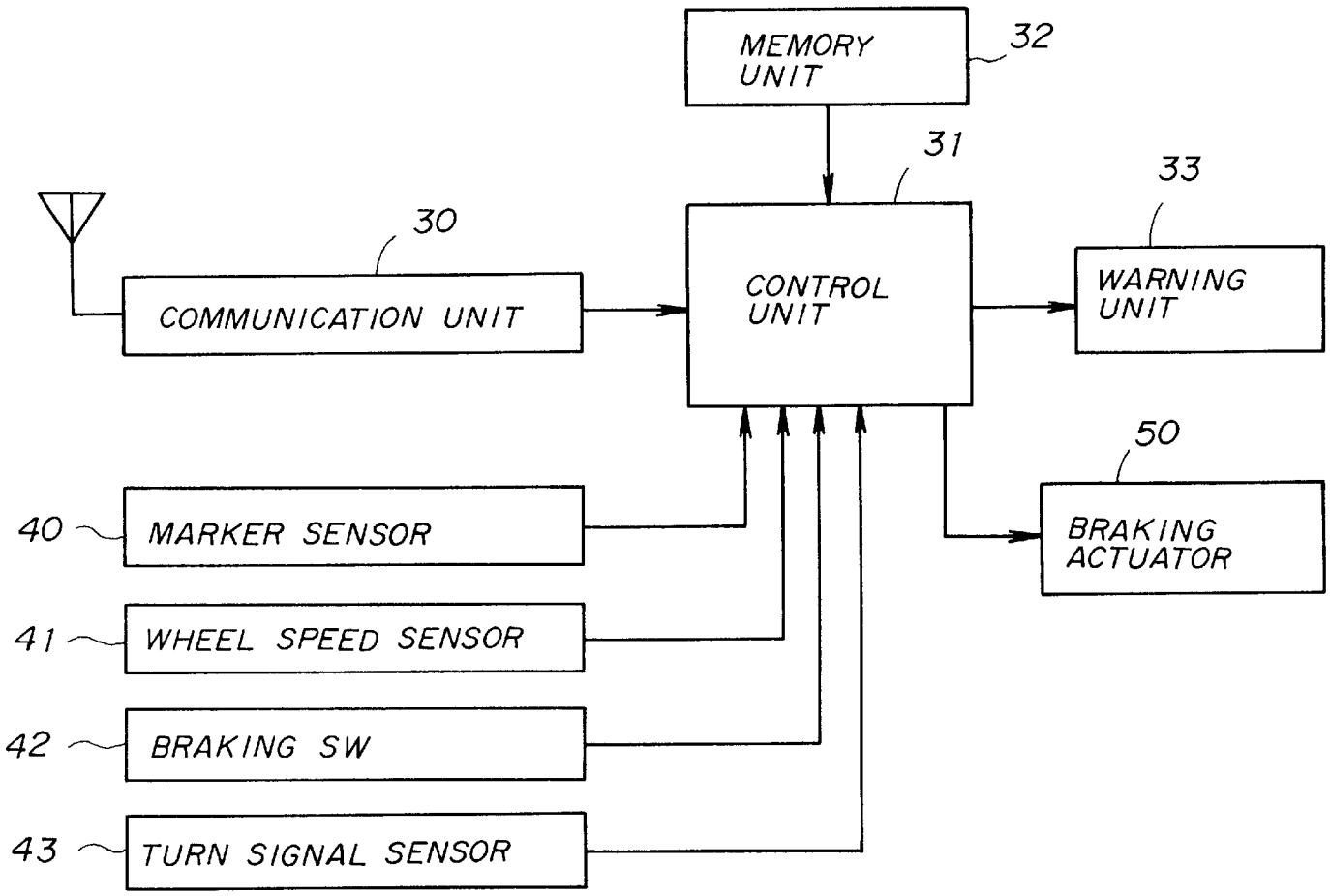
FIG. 3 is a block diagram illustrating an intersection warning system provided in a vehicle.

An intersection warning system provided in a vehicle is formed as shown in FIG. 3.

Referring to FIG. 3, the intersection warning system has a communication unit 30, a control unit 31, a memory unit 32 and a warning unit 33. The communication unit 30 carries out data communication (roadside-vehicle communication) with the roadside communication unit 100 installed near the intersection (see FIG. 1) so as to receive the watching information. The memory unit 32 stores various constants used in processes of the control unit 31. A marker sensor 40 detects the information emitted by the lane marker 101. A detecting signal from the marker sensor 40, wheel speed pulses from a wheel speed sensor 41, an operation signal from a braking switch 42 and a direction indicating signal (a turn signal) from a direction indicating sensor 43 (a turn signal sensor) are supplied to the control unit 31. The control unit 31 carries out a warning information generating process, which will be described later, based on the watching information from the communication unit 30, constants read out of the memory unit 32 and respective signals from the marker sensor 40, the wheel speed sensor 41, the braking switch 42 and the direction indicating sensor 43.

Figure 4:
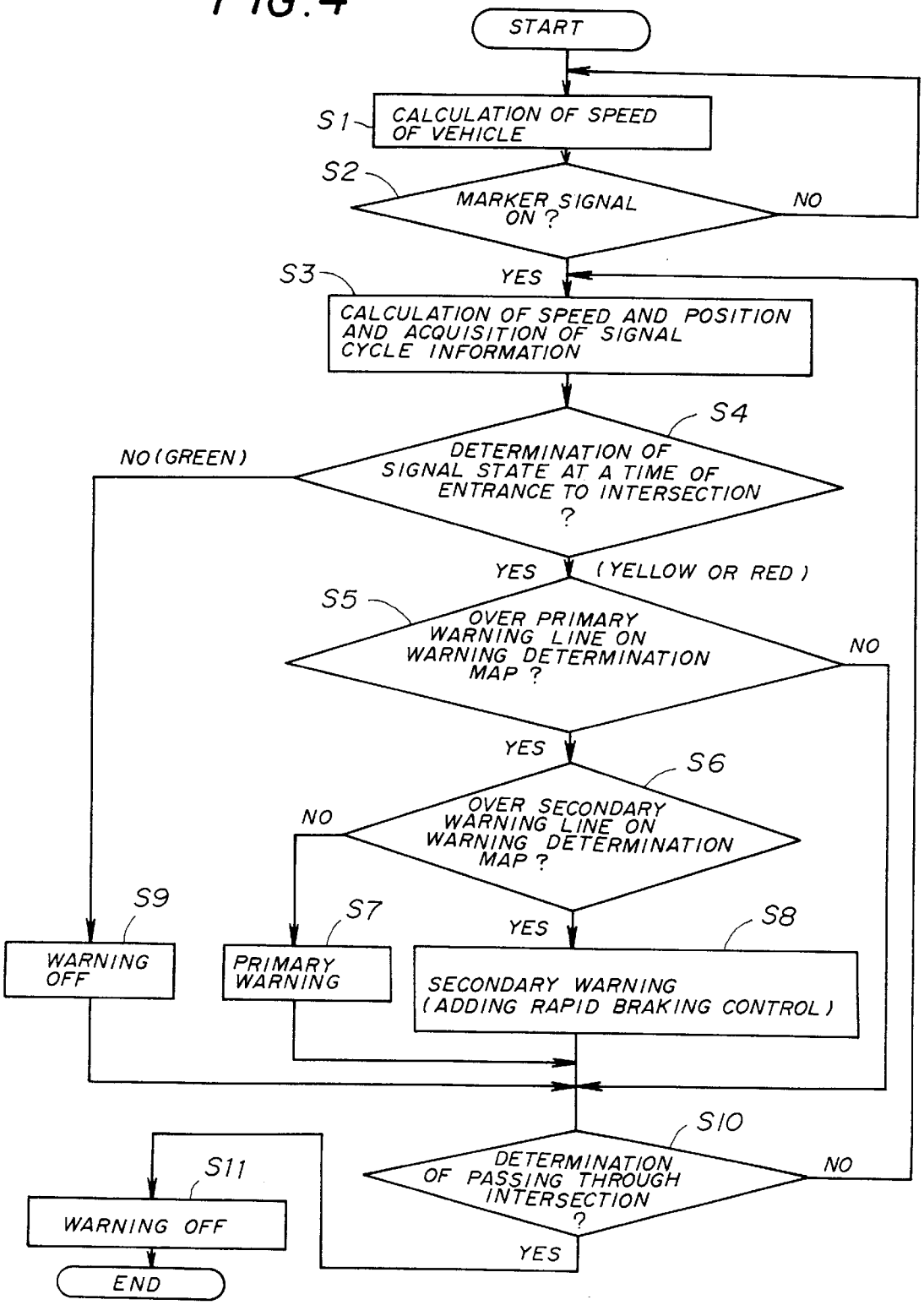
FIG. 4 is a flowchart illustrating a procedure of a process for a warning.

The warning information generating process is executed in accordance with a procedure as shown in FIG. 4.

Referring to FIG. 4, the control unit 31 calculates a speed of the vehicle based on the wheel speed pulses from the wheel speed sensor 41 (S1). The control unit 31 further determines, based on the detecting signal from the marker sensor 40, whether the vehicle V passes over the lane marker 101 (S2). When it is determined that the vehicle V passes over the lane marker 101, the control unit 31 calculates the speed of the vehicle V again based on the wheel speed pulses from the wheel speed sensor 41 and the position of the vehicle V (the distance between the vehicle V and the stop line SL) based on the information obtained from the lane marker 101 (S3). The control unit 31 further acquires the watching information (the figure information of the intersection, the state of the traffic signal 200, the timing information and the switching cycle) received by the communication unit 30 (S3).

A direction in which the vehicle V is going to pass the intersection is then determined based on the information from the marker sensor 40 and the direction indicating signal (the turn signal) from the direction indicating sensor 43 (S4). Further, based on the calculated speed, the position of the vehicle V, the information about the state of the traffic signal 200, the timing information and the switching cycle, the signal state of the traffic signal 200 when the vehicle V reaches the stop line SL (when the vehicle V enters the intersection) is estimated. The estimate of the signal state of the traffic signal 200 is made as follows.

Figure 5:
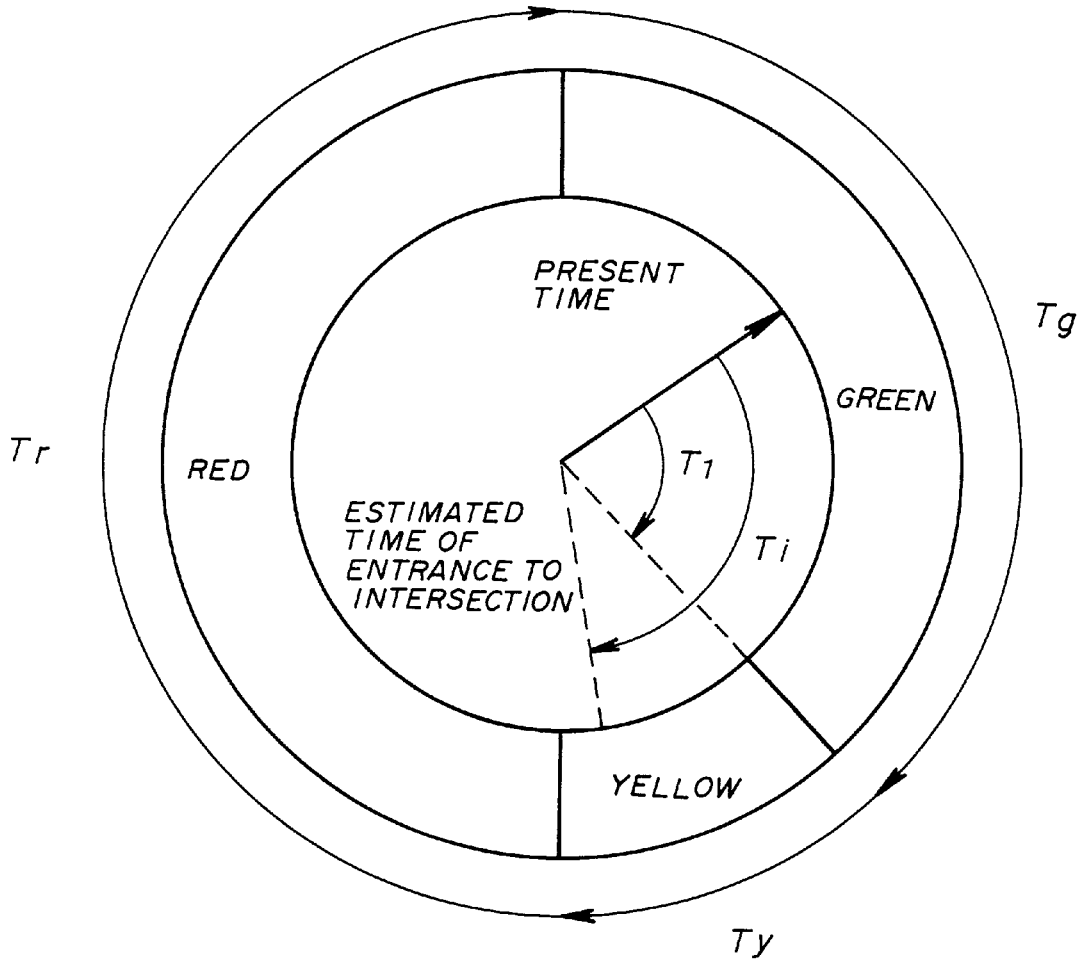
FIG. 5 is a diagram (No.1) illustrating a relationship between a switching cycle of a traffic signal and a present time.
Figure 6:
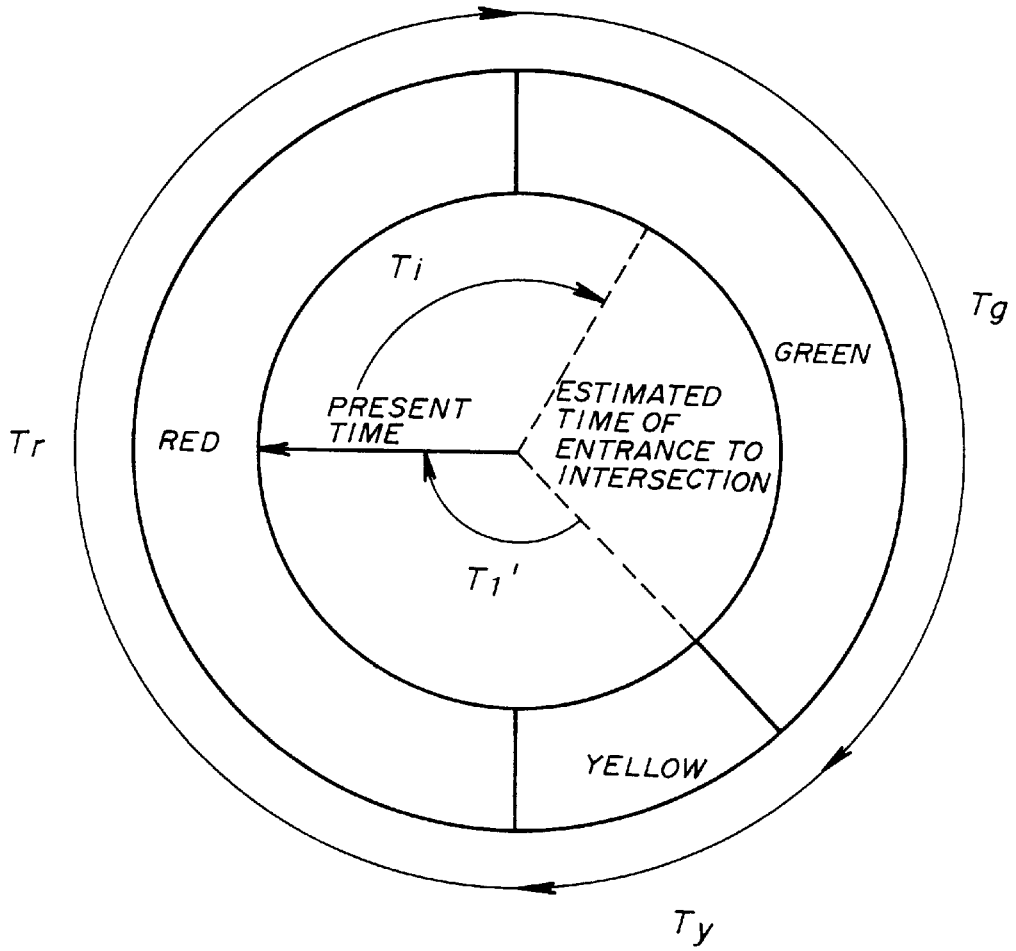
FIG. 6 is a diagram (No.2) illustrating a relationship between a switching cycle of a traffic signal and a present time.

As shown in FIGS. 5 and 6, periods Tg (green), Ty (yellow) and Tr (red) for respective signal states in the signal switching cycle are supplied from the road watching apparatus. If the present time is in the period for the green signal as shown in FIG. 5, a time period T1 from the present time to a time at which the green signal is turned to the yellow signal and a time period Ti required for the vehicle V to reach the stop line SL are respectively calculated. When the time period T1 is equal to or greater than the time period Ti ($Ti-Ti \geqq 0$), it is estimated that the signal state is "green" when the vehicle reaches the stop line SL. In addition, when the time period T1 is less than the time period Ti ($T1-Ti<0$), it is estimated that the signal state is "red" or "yellow" when the vehicle reaches the stop line SL. When the following condition is satisfied, it is estimated that the signal state is "green" when the vehicle V reaches the stop line SL.

$$0<(Ti-T1)-(Ty+Tr)<Tg$$

On the other hand, if the present time is in the period for the red or yellow signal as shown in FIG. 6, a time period T1 from a time at which the yellow signal starts to the present time and the time Ti required for the vehicle V to reach the stop line SL are respectively calculated. When the following condition is satisfied, it is estimated that the signal state is "green" when the vehicle V reaches the stop line SL.

$$0<(T1'+Ti)-(Ty+Tr)<Tg$$

When another condition is satisfied, it is estimated that the signal state is "red" or "yellow" when the vehicle V reaches the stop line SL.

In a case where the time period Ti required for the vehicle V to reach the stop line SL is greater than one signal cycle Ta (Ti>Tg+Ty+Tr=Ta), a time period Ti', defined as follows, is substituted for the time period Ti.

$$Ti'=Ti-nTa \text{ (n: an integer)}$$

As has been described above, when it is estimated that the signal state is "green" when the vehicle V reaches the stop line SL, it is determined that a warning is not needed. On the other hand, when it is estimated that the signal state is "red" or "yellow" when the vehicle reaches the stop line SL, it is determined that a process for deciding based on the running state of the vehicle V whether a warning should be issued is needed.

Figure 7:
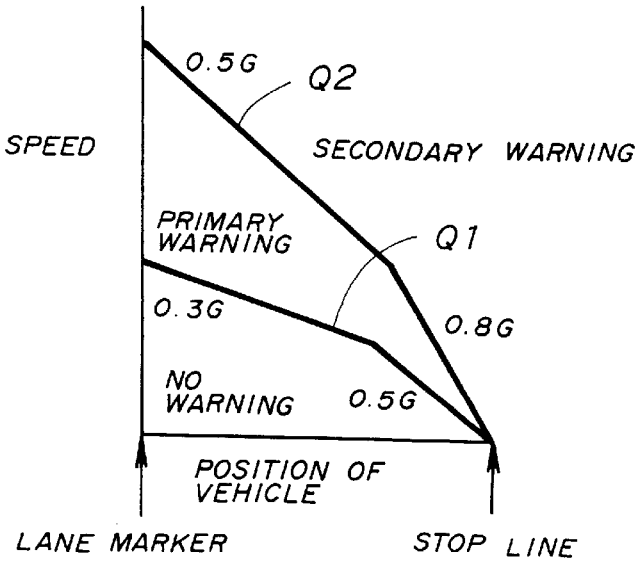
FIG. 7 is a diagram illustrating an example of a warning determination map.

Thus, when it is estimated that that the signal state is "red" or "yellow" when the vehicle V reaches the stop line (YES in step S4), it is determined, based on the calculated speed of the vehicle V and the distance between the present position of the vehicle V and the stop line SL, whether a warning should be issued. When it is determined that a warning should be issued, it is further determined what kind of warning should be issued. These determination processes are carried out using a warning determination map as shown in FIG. 7. The warning determination map shown in FIG. 7 indicates kinds of warning (no warning, a primary warning and a secondary warning) corresponding to relationships between speeds and positions of a vehicle. For example, the warning determination map is transmitted, along with the watching information, from the roadside communication unit 100 to the intersection warning system provided in the vehicle V. The warning determination map may also be made by the control unit 31 of the intersection warning system based on the information (the distance between the lane marker 101 and the stop line SL) obtained when the lane marker 101 is detected.

When a point indicating a relationship between the present running position (the distance from the stop line SL) and the speed of the vehicle is under a first reference deceleration characteristic Q1 in the warning determination map (No in step S5), the vehicle can be decelerated from the present running state (the present speed) in accordance with a deceleration characteristic varied more slowly than the first reference deceleration characteristic Q1 to stop before the stop line SL. Thus, it is determined that a warning is not needed. When a point indicating a relationship between the present running position and the speed of the vehicle is between the first reference deceleration characteristic Q1 and a second reference deceleration characteristic Q2 in the warning determination map (YES in step S5 and NO in step S6), the vehicle has to be decelerated from the present running state in accordance with a deceleration characteristic varied more rapidly than the first reference deceleration characteristic Q1 but more slowly than the second reference deceleration characteristic Q2 to stop before the stop line SL. Thus, it is determined the primary warning should be issued (S7). Further, when a point indicating a relationship between the present running position and the speed of the vehicle is over the second reference deceleration characteristic Q2 in the warning determination map (YES in step S5 and YES in step S6), the vehicle has to be decelerated from the present running state in accordance with a deceleration characteristic varied more rapidly than the second reference deceleration characteristic Q2 to stop before the stop line SL. Thus, it is determined that a secondary warning needed in a case more emergent than that for the primary warning should be issued.

The warning information (no warning, the primary warning or the secondary warning) generated based on the determination result as described above is supplied from the control unit 31 to the warning unit 33. The warning unit 33 outputs the primary warning or the secondary warning based on the warning information. In the primary warning, for example, a message recommending a braking operation is output in voice and displayed. In the secondary warning, for example, a warning sound representing the emergency is output.

When the determination process about the warning is completed, the control unit 31 determines, based on the distance between the lane marker 101 and the stop line SL and present position of the vehicle, whether the vehicle has passed through the intersection (S10). Until it is determined that the vehicle has passed through the intersection, the control unit 31 repeatedly carries out the above processes (S3, S4, S5, S6, S7 and S8). In the processes, when the driver corrects the driving operation (the braking operation) based on the warning (the primary warning or the secondary warning) so that a point indicating the relationship between the present running position and the speed of the vehicle comes into an area under the first reference deceleration characteristic Q1 (NO in step S5), the process (S6) for the secondary warning is passed and other processes are repeatedly carried out.

The estimate that the signal state is "green" when the vehicle V reaches the stop line SL (NO in step S4) means that any warning is not needed. Thus, in this case, if a warning has been issued in the previous processing cycle, a process (S9) for terminating the warning is carried out. Then, until it is determined that the vehicle V has passed through the intersection, the calculation of the speed and position of the vehicle, the acquisition of the watching information (S3), the estimation of the signal state (S4) and the process based on the estimate result are repeatedly executed.

In the above processes, if the vehicle V has passed through the intersection (YES in step S10), the control unit 31 causes the warning to stop (S11) and completes the processes about the warning.

Figure 8:
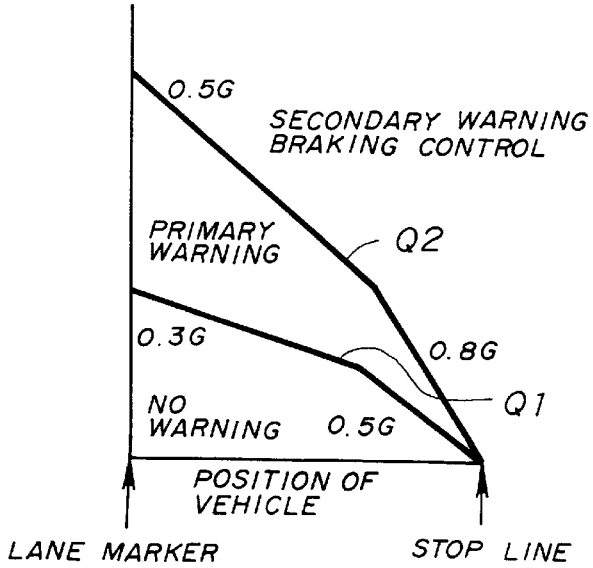
FIG. 8 is a diagram illustrating another example of the warning determination map.

A warning determination map shown in FIG. 8 may be substituted for the warning determination map shown in FIG. 7. The warning determination map shown in FIG. 8 is useful in a case where the driver does not correct the driving operation although the secondary warning has been issued. When a point indicating the relationship between the present position and the speed of the vehicle is over the second reference deceleration characteristic Q2 in the warning determination map, a braking control is performed to rapidly brake the vehicle in addition to issuing the secondary warning. For example, when it is determined that the secondary warning should be issued, the control unit 31 determines based on the operation signal from the braking switch whether a braking operation has been performed. If it is determined that the braking operation has not yet been performed, a control signal for rapidly braking is supplied to a braking actuator 50 (S8). As a result, the vehicle V is rapidly braked. Thus, the vehicle V is prevented from entering the intersection.

In the above embodiment, when it is estimated that the signal state is "red" or "yellow" when the vehicle reaches the stop line SL, the primary warning or the secondary warning is issued based on a degree of the emergency decided in accordance with the present running state of the vehicle and the distance between the present position of the vehicle and the stop line. Thus, the intersection warning system is useful for the driver of the vehicle approaching the intersection to stop before the stop line.

The present invention is not limited to the aforementioned embodiments, and other variations and modifications may be made without departing from the scope of the claimed invention.

The present application is based on Japanese Priority Application No.9-206971 filed on Jul. 31, 1997, the entire contents of which are hereby incorporated by reference.

What is claimed is:

1. An intersection warning system provided in a vehicle comprising:

a distance detecting unit detecting a distance between a position at which said vehicle runs toward an intersection and a boundary position set for vehicles to stop before the intersection;

a running state detecting unit detecting a running state of said vehicle;

a determination unit determining whether the detected running state of said vehicle is appropriate by estimating a running state of said vehicle at the boundary position based on the distance detected by said distance detecting unit and the detected running state of said vehicle; and a warning unit issuing a warning to a driver of said vehicle based on a result obtained by said determination unit.

2. The intersection warning system as claimed in claim 1 further comprising:

a signal information receiving unit receiving information about a signal state of a traffic signal provided at the intersection and a switching cycle of said traffic signal from a roadside system; and an estimate unit estimating the signal state of the traffic signal when said vehicle enters the intersection based on the detected distance to the boundary position, the detected running state and the information received by said signal information receiving unit, wherein said determination unit determines whether the detected running state is appropriate additionally based on the estimate result obtained by said estimate unit.

3. The intersection warning system as claimed in claim 1 further comprising:

a braking control unit carrying out a braking control of said vehicle based on the result obtained by said determination unit.

4. An intersection warning system provided in a vehicle comprising:

distance detecting means for detecting a distance between a position at which said vehicle runs toward an intersection and a boundary position set for vehicles to stop before the intersection;

running state detecting means for detecting a running state of said vehicle;

determination means for determining whether the detected running state of said vehicle is appropriate by estimating a running state of said vehicle at the boundary position based on the distance detected by said distance detecting unit and the detected running state of said vehicle; and warning means for issuing a warning to a driver of said vehicle based on a result obtained by said determination means.

5. The intersection warning system as claimed in claim 4 further comprising:

signal information receiving means for receiving information about a signal state of a traffic signal provided at the intersection and a switching cycle of said traffic signal from a roadside system; and estimate means for estimating the signal state of the traffic signal when said vehicle enters the intersection based on the detected distance to the boundary position, the detected running state and the information received by said signal information receiving unit, wherein said determination means determines whether the detected running state is appropriate additionally based on the estimate result obtained by said estimate means.

6. The intersection warning system as claimed in claim 4 further comprising:

braking control means for carrying out a braking control of said vehicle based on the result obtained by said determination means.

* * * * *